US007971509B2

(12) United States Patent
Shortridge

(10) Patent No.: US 7,971,509 B2
(45) Date of Patent: Jul. 5, 2011

(54) DUAL SCREWDRIVER ADAPTABLE TO CONNECTOR ASSEMBLIES OF DIFFERENT TYPES AND SIZES

(75) Inventor: Ronald Wiley Shortridge, Phoenix, AZ (US)

(73) Assignee: Honeywell International Inc., Morristown, NJ (US)

( * ) Notice: Subject to any disclaimer, the term of this patent is extended or adjusted under 35 U.S.C. 154(b) by 311 days.

(21) Appl. No.: 12/354,462

(22) Filed: Jan. 15, 2009

(65) Prior Publication Data

US 2010/0175511 A1 Jul. 15, 2010

(51) Int. Cl.
*B25B 17/00* (2006.01)
*B25B 23/00* (2006.01)

(52) U.S. Cl. ..... 81/57.22; 81/64; 81/57.3; 81/57.27; 81/57.32; 81/57.36

(58) Field of Classification Search ..... 81/57.22, 81/57.14, 57.3, 57.27, 57.32, 57.36, 64, 124.4
See application file for complete search history.

(56) References Cited

U.S. PATENT DOCUMENTS 2,372,930 A * 4/1945 Bovee ..... 81/64
2,964,152 A * 12/1960 Banner ..... 192/56.32
3,805,645 A 4/1974 Jenny
4,515,043 A 5/1985 Gray
4,997,305 A 3/1991 Yang
5,086,674 A * 2/1992 Her ..... 81/124.4
5,098,312 A 3/1992 Raczynski
5,169,334 A 12/1992 Makita
5,218,758 A 6/1993 Nguyen
5,361,654 A * 11/1994 Rasipovits ..... 81/64
6,189,418 B1 2/2001 Sloan et al.
6,253,644 B1 7/2001 Duquette
6,543,314 B1 4/2003 Hoyt
6,834,567 B2 12/2004 Rosetto
7,077,031 B1 7/2006 Frederiksen

* cited by examiner

*Primary Examiner* — D. S Meislin
(74) *Attorney, Agent, or Firm* — Ingrassia Fisher & Lorenz, P.C.

(57) ABSTRACT

A dual screwdriver is provided for connecting and disconnecting a connector assembly having first and second jackscrew guideposts. In one embodiment, the dual screwdriver includes a housing, a user input rotatably coupled to the housing, first and second manually-bendable shafts each rotatably coupled to the housing, and first and second bits mounted to the distal end portions of first and second manually-bendable shafts, respectively. The first and second bits are configured to matingly engage the first and second jackscrew guideposts. A gear train is disposed in the housing and mechanically couples the user input to the first and second manually-bendable shafts. The rotation of the user input drives the rotation of the first and second manually-bendable shafts and, therefore, the rotation of the first and second jackscrew guideposts when matingly engaged by the first and second bits, respectively.

6 Claims, 4 Drawing Sheets

DUAL SCREWDRIVER ADAPTABLE TO CONNECTOR ASSEMBLIES OF DIFFERENT TYPES AND SIZES

TECHNICAL FIELD

The present invention relates generally to electronics assembly tools and, more particularly, to a dual screwdriver having manually-bendable shafts suitable for connecting and disconnecting electrical connector assemblies of various types and sizes.

BACKGROUND

The electrical infrastructure of a modern aircraft typically includes numerous modular electrical devices located throughout the aircraft's body. High density connector assemblies are commonly utilized to interconnect these modular electrical devices. For example, a high density PC card-to-board connector assembly may be utilized to connect a circuit card, which is mounted at a first location within the aircraft, to a processor-carrying circuit board, which is mounted at a second location within the aircraft. A representative high density connector assembly includes a male connector (commonly referred to as a "plug") and a female connector (commonly referred to as a "receptacle"). The plug and receptacle each carry a particular number and type of contacts (e.g., 9, 15, 25, or 37 pin-type or socket-type contacts). When the plug and receptacle are properly connected, each plug contact matingly engages a corresponding receptacle contact to permit the exchange of electrical signals and current.

To maintain the proper spatial orientation of the plug and receptacle, many connector assemblies are further provided with first and second jacksets disposed on opposing sides of the contact array. Each jackset includes a jackscrew guidepost, which may be rotatably mounted through the plug, and a jackscrew, which may be rotatably mounted through the receptacle. The jackscrew guidepost may have a slotted head, a hexagonal socket head, or other standardized connector head. To connect the receptacle to the plug, a technician first aligns each jackscrew guidepost with its corresponding jackscrew. Utilizing his or her fingers or a generalized tool, such as a screwdriver or hex key (e.g., an ALLEN® wrench), the technician begins to rotate a first jackscrew guidepost, which threadably engages its mating jackscrew. After several turns of the first jackscrew guidepost, the technician then rotates the second jackscrew guide post, which threadably engages its mating jackscrew. The technician alternates between rotation of the first and the second jackscrew guideposts until the inner face of the plug abuts the inner face of receptacle to complete connection of the connector assembly.

Manually connecting connector assemblies in the manner described above is a tedious and time consuming task, especially when performed repetitively to connect the numerous connector assemblies included within a typical aircraft electrical system. In addition, when the jackscrew guideposts are turned independently, damage to the contacts may occur if one jackscrew guidepost is over-rotated relative to the other jackscrew guidepost. Damage to a single connector contained within a connector assembly may necessitate replacement of the entire connector assembly.

Considering the above, it would be desirable to provide a specialized tool (referred to herein as a "dual screwdriver") for connecting and disconnecting high density electrical connector assemblies of the type described above. It would also be desirable for such a dual screwdriver to rotate a pair of jackscrew guideposts simultaneously, in the same rotational direction, and at the same rotational rate to prevent the over-rotation of either jackscrew guidepost. Ideally, such a dual screwdriver would be adaptable to electrical connector assemblies of various types and sizes. For example, it would be desirable for embodiments of such a dual screwdriver to readily fit a first (e.g., 9-connector) electrical connector assembly wherein the lateral spacing between the jackscrew guideposts is relatively small, as well as a second (e.g., 37-connector) electrical connector assembly wherein the lateral spacing between the jackscrew guideposts is relatively large. It would also be desirable for embodiments of such a dual screwdriver to readily interface with jackscrew guideposts having various head types, including slotted head types and hexagonal socket head types. Other desirable features and characteristics of the present invention will become apparent from the subsequent Detailed Description and the appended claims, taken in conjunction with the accompanying drawings and this Background.

BRIEF SUMMARY

A dual screwdriver is provided for connecting and disconnecting a connector assembly having first and second jackscrew guideposts. In one embodiment, the dual screwdriver includes a housing, a user input rotatably coupled to the housing, first and second manually-bendable shafts each rotatably coupled to the housing, and first and second bits mounted to the distal end portions of first and second manually-bendable shafts, respectively. The first and second bits are configured to matingly engage the first and second jackscrew guideposts, respectively. A gear train is disposed in the housing and mechanically couples the user input to the first and second manually-bendable shafts. The rotation of the user input drives the rotation of the first and second manually-bendable shafts and, therefore, the rotation of the first and second jackscrew guideposts when matingly engaged by the first and second bits.

BRIEF DESCRIPTION OF THE DRAWINGS

At least one example of the present invention will hereinafter be described in conjunction with the following figures, wherein like numerals denote like elements, and.

DETAILED DESCRIPTION

The following Detailed Description is merely exemplary in nature and is not intended to limit the invention or the application and uses of the invention. Furthermore, there is no intention to be bound by any theory presented in the preceding Background or the following Detailed Description.

Figure 1:
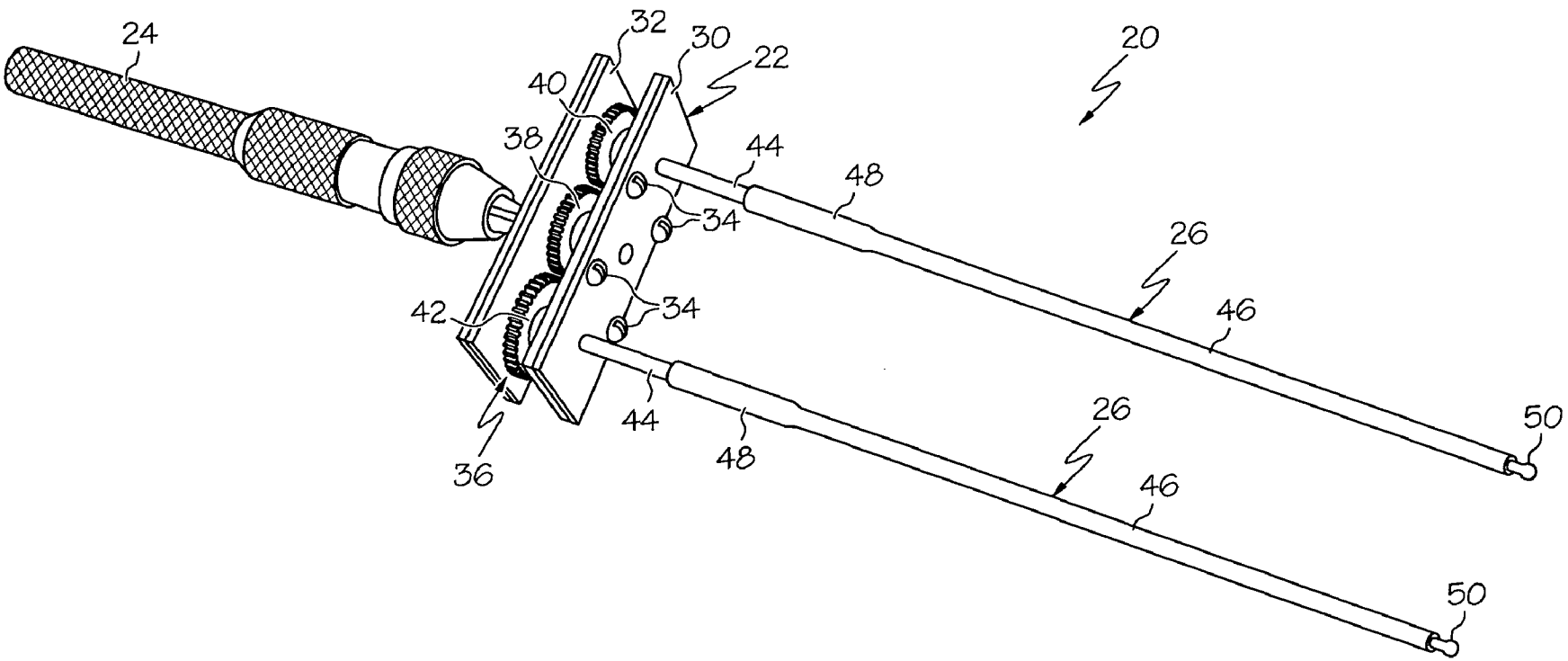
FIG. 1 is an isometric view of a dual screwdriver having first and second manually-bendable shafts in accordance with an exemplary embodiment.

FIG. 1 is an isometric view of a dual screwdriver 20 in accordance with an exemplary embodiment. Dual screwdriver 20 includes a housing 22, a user input 24, a first manually-bendable shaft 26, and a second manually-bendable shaft 28. Housing 22, in turn, includes a face plate 30 and a back plate 32, which are fixedly joined together utilizing a number of fasteners 34 (e.g., bolts). User input 24 is rotatably coupled to back plate 32 and extends away therefrom in a first direction, and first and second manually-bendable shafts 26 and 28 are each rotatably coupled to face plate 30 and extend away therefrom in a second opposing direction. A gear train 36 is disposed within housing 22 and mechanically couples user input 24 to first and second manually-bendable shafts 26 and 28 such that the rotation of user input 24 drives the simultaneous rotation of shafts 26 and 28 as described more fully below. In the illustrated exemplary embodiment, user input 24 assumes the form of an elongated handle that may be manually rotated by a technician. In alternative embodiments, user input 24 may assume the form of other manually-rotatable inputs, such as a rotatable dial mounted within a stationary handle affixed to housing 22. In still further embodiments, user input 24 may comprise an electrical input (e.g., a switch, button, or dial) that energizes an electrical motor, which then drives the rotation of gear train 36.

In the exemplary embodiment shown in FIG. 1, gear train 36 includes three gears, namely, a central drive gear 38, a first peripheral driven gear 40, and a second peripheral driven gear 42. Central drive gear 38 is disposed between, and meshes with, peripheral driven gears 40 and 42. Central drive gear 38 is also fixedly coupled to user input 24 through back plate 32. During operation of dual screwdriver 20, a technician turns user input 24 to impart rotary motion to central drive gear 38, which, in turn, imparts rotary motion to peripheral driven gears 40 and 42. Peripheral driven gears 40 and 42 are fixedly coupled to manually-bendable shafts 26 and 28, respectively, through face plate 30; thus, as the technician turns user input 24, manually-bendable shafts 26 and 28 rotate along with peripheral driven gears 40 and 42. Due to the configuration of gear train 36, peripheral driven gears 40 and 42 and shafts 26 and 28 rotate simultaneously and in a rotational direction opposite that of user input 24 and central drive gear 38. Peripheral driven gears 40 and 42 and shafts 26 and 28 also rotate at the same rotational rate, which may or may not be same rate at which user input 24 and central drive gear 38 is rotated. In the example shown in FIG. 1, gears 38, 40, and 42 each have an equivalent outer diameter and tooth count; consequently, the rotational rate of peripheral driven gears 40 and 42 and shafts 26 and 28 will be substantially equivalent to the rotational rate of user input 24 and central drive gear 38.

Dual screwdriver 20 further includes first and second bits 50, which are mounted to the distal ends of manually-bendable shafts 26 and 28, respectively. Bits 50 permit dual screwdriver 20 to matingly engage the jackscrew guideposts of a connector assembly. In FIG. 1, bits 50 each assume a hexagonal shape suitable for matingly engaging a jackscrew guidepost including a head having a hexagonal depression of size corresponding to bit 50. Hexagonal bits 50 may be fixedly mounted to the distal end of shafts 26 and 28 utilizing, for example, an adhesive. However, it is preferred that hexagonal bits 50 are removably mounted to the distal ends of shafts 26 and 28 so as to permit bits 50 to be interchanged with bits of other sizes and types as described more fully below in conjunction with FIGS. 2 and 3.

As a point of emphasis, manually-bendable shafts 26 and 28 are sufficiently flexible that a technician may bend shafts 26 and 28 into a desired shape with relative ease, either by hand or by manual manipulation of dual screwdriver 20. At the same time, manually shafts 26 and 28 are stiff enough to provide adequate torque transfer from gear train 36 to bits 50. In the illustrated exemplary embodiment, manually-bendable shafts 26 and 28 each include two main components: (i) a base post 44, which extends through face plate 30; and (ii) an elongated flexible body 46, which is affixed to base post 44. Base post 44 of manually-bendable shaft 26 is fixedly coupled to gear 40, and base post 44 of manually-bendable shaft 28 is fixedly coupled to gear 42. Base posts 44 are each preferably formed from a rigid material, such as a metal or alloy. In contrast, elongated flexible bodies 46 are each formed from a flexible material, such as a polymer. In certain embodiments, elongated flexible bodies 46 each comprise a length of polymeric tubing having a longitudinal channel therein. In such embodiments, the proximal end of each elongated flexible body 46 may be disposed over and adhesively joined to its corresponding base post 44 as generally shown in FIG. 1 at 48.

Figure 3:
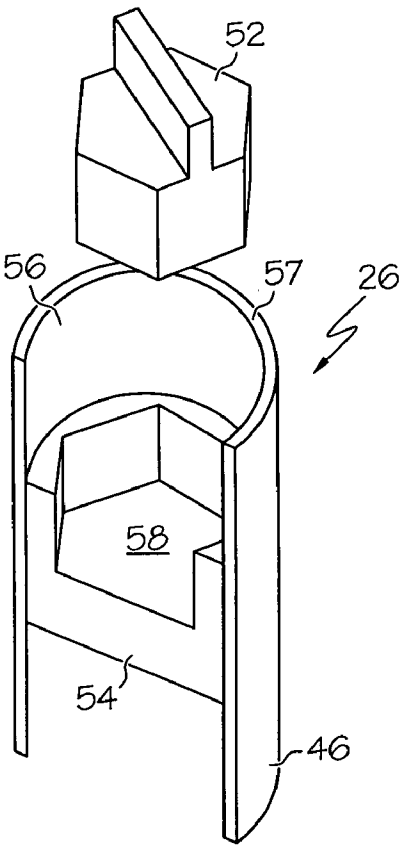
FIGS. 2 and 3 are cross-sectional views illustrating one manner in which a hexagonal bit (FIG. 2) and a flat head bit (FIG. 3) may be removably mounted to the distal end portion of the dual screwdriver's first manually-bendable shaft.
Figure 2:
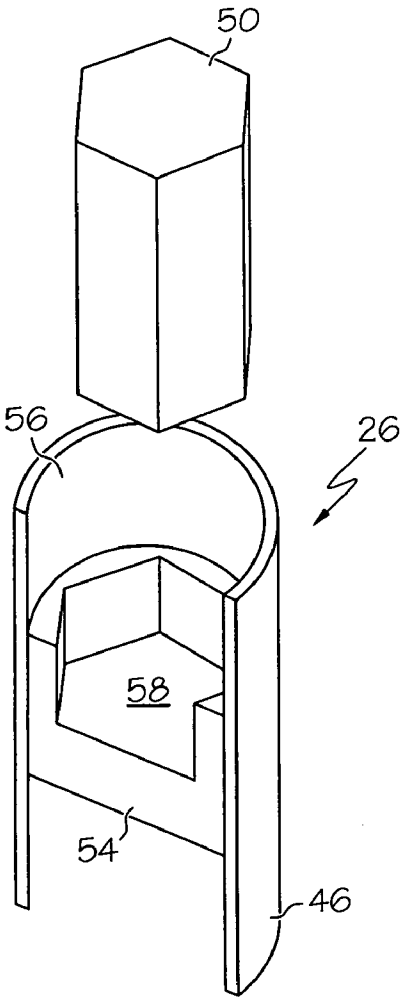

FIGS. 2 and 3 are cross-sectional views illustrating one manner in which manually-bendable shaft 26 may be configured to permit hexagonal bit 50 (FIG. 2) to be interchanged with a second bit, in particular, a flat head bit 52 (FIG. 3). Manually-bendable shaft 26 is substantially identical to manually-bendable shaft 28; thus, the following description applies equally to shaft 28. As can be seen in FIGS. 2 and 3, an cylindrical adapter 54 is mounted within the longitudinal channel of flexible body 46 utilizing, for example, an adhesive. Adapter 54 is recessed within the distal end portion of flexible body 46 and manually accessible through a distal opening 56 provided in flexible body 46. Adapter 54 includes a hexagonal depression 58, which corresponds to the hexagonal shape of the base of hexagonal bit 50 (FIG. 2) and of flat head bit 52 (FIG. 3). A technician may insert bit 50 or bit 52 through distal opening 56 and into adapter 54 such that the base portion of bit 50 or bit 52 is received within, and is generally retained by, hexagonal depression 58. In certain embodiments, bit 50 and bit 52 may be configured to be magnetically attracted to adapter 54 to further secure bits 50 and 52 thereto; e.g., adapter 54 may be magnetized or have a permanent magnet mounted thereto, and bits 50 and 52 may be machined from a magnetically-permeable metal or alloy. In further embodiments, other retention means may be utilized to temporarily secure bits 50 and 52 to adapter 54, such as a threaded interface.

With continued reference to FIGS. 2 and 3, it may be noted that the length of hexagonal bit 50 is greater than the length of flat head bit 52. When hexagonal bit 50 is received by adapter 54, the proximal end of hexagonal bit 50 extends through distal opening 56 and protrudes from flexible body 46. In contrast, when flat head bit 52 is received by adapter 54, flat head bit 52 is recessed within the distal end portion of flexible body 46. As a result, when installed within adapter 54, flat head bit 52 will be generally circumscribed by a generally annular collar or shroud 57 (labeled in FIG. 3). When flat head bit 52 matingly engages a slotted head jackscrew guidepost, annular shroud 57 circumferentially engages an outer surface of the jackscrew guidepost. In this manner, shroud 57 helps to maintain engagement between flat head bit 52 and the slotted head jackscrew guidepost even when manually-bendable shaft 26 flexes to accommodate the lateral spacing between a pair of jackscrew guideposts as described more fully below in conjunction with FIGS. 6 and 7.

Figure 5:
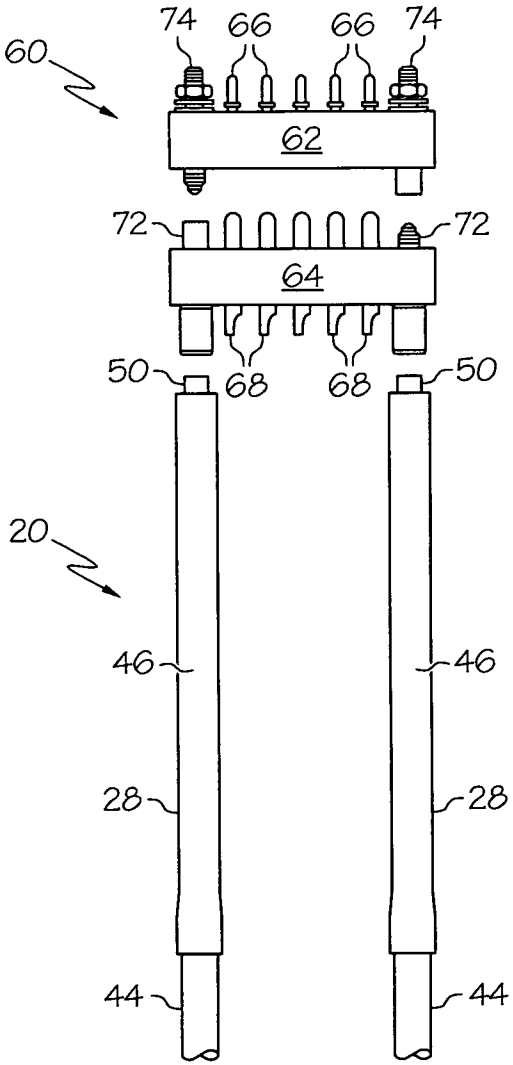
FIG. 5 is an exploded side view of the distal end portion of the dual screwdriver shown in FIG. 1 illustrating one manner in which the exemplary dual screwdriver may interface with the ten-pin connector assembly shown in FIG. 4.
Figure 4:
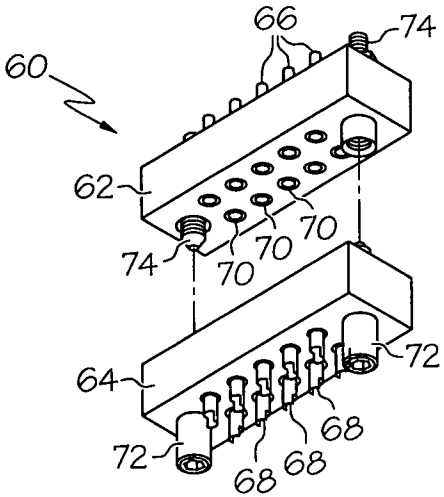
FIG. 4 (PRIOR ART)
FIG. 4 is an exploded isometric view of an exemplary ten-pin connector assembly including first and second jackscrew guideposts having a hexagonal socket head.

FIG. 4 is an exploded isometric view of a first exemplary high density connector assembly 60; and FIG. 5 is an exploded side view of connector assembly 60 illustrating one manner in which assembly 60 may be engaged by the distal portion of dual screwdriver 20. Connector assembly 60 includes a female receptacle 62 and a male plug 64. Receptacle 62 includes ten contacts 66, which assume the form of pins that extend partially through the body of receptacle 62; and plug 64 includes ten contacts 68, which assume the form of solder-cup type pins that extend fully through the body of plug 64 and which are arranged in an array corresponding to contacts 66 of receptacle 62. As is shown most clearly in FIG. 4, a plurality of apertures 70 is formed through the inner face of receptacle 62. Each contact 66 is exposed through a different aperture 70. When connector assembly 60 is properly connected, plug 64 matingly engages receptacle 62 such that contacts 68 extend into apertures 70 and electrically contact contacts 66.

Connector assembly 60 is further equipped with first and second jacksets disposed on opposing sides of contacts 66 and 68. Each jackset includes a jackscrew guidepost 72, which is rotatably disposed through plug 64, and a jackscrew 74, which is rotatably disposed through receptacle 62. Jackscrew guideposts 72 are configured to threadably engage jackscrews 74 to secure plug 64 to receptacle 62; e.g., one jackscrew guidepost 72 may include an outer threading that engages the inner threading of a first jackscrew 74, and the other jackscrew guidepost 72 may include an inner threading that engages the outer threading of the second jackscrew 74. Due, in part, to the relatively low contact count of connector assembly 60, the lateral spacing between jackscrew guideposts 72 is relatively small (e.g., approximately 0.650 inch).

As indicated in FIG. 5, dual screwdriver 20 may be conveniently utilized to connect and disconnect connector assembly 60 in the following manner. First, a technician ensures that the manually-bendable shafts 26 and 28 each carry the bit type and size corresponding to jackscrew guideposts 72. As shown in FIG. 4, jackscrew guideposts 72 each have a hexagonal-socket head of a particular size (e.g., 5⁄32 of an inch); thus, manually-bendable shafts 26 and 28 may each be equipped with an appropriately-sized hexagonal bit 50 (also shown in FIG. 2). Next, the technician manipulates dual screwdriver 20 such that bits 50 matingly engage jackscrew guideposts 72. Due to the flexibility of elongated bodies 46, manually-bendable shafts 26 and 28 may be bent as needed to accommodate the lateral spacing of jackscrew guideposts 72. However, in the example shown in FIG. 5, the lateral spacing of manually-bendable shafts 26 and 28 is substantially equivalent to the lateral spacing of jackscrew guideposts 72; consequently, manually-bendable shafts 26 and 28 may align with jackscrew guideposts 72 with minimal bending. Hexagonal bits 50 are generally retained within the hexagonal sockets provided in jackscrew guideposts 72 even when manually-bendable shafts 26 and 28 are bent, within certain limits, by a technician. Thus, after engaging bits 50 within jackscrew guideposts 72, a technician may generally position user input 24 and housing 22 as needed without causing hexagonal bits 50 to disengage from jackscrew guideposts 72. To connect or disconnect connector assembly 60, the technician then turns user input 24 to drive the simultaneous rotation of manually-bendable shafts 26 and 28 and, therefore, the simultaneous rotation of jackscrew guideposts 72.

Figure 7:
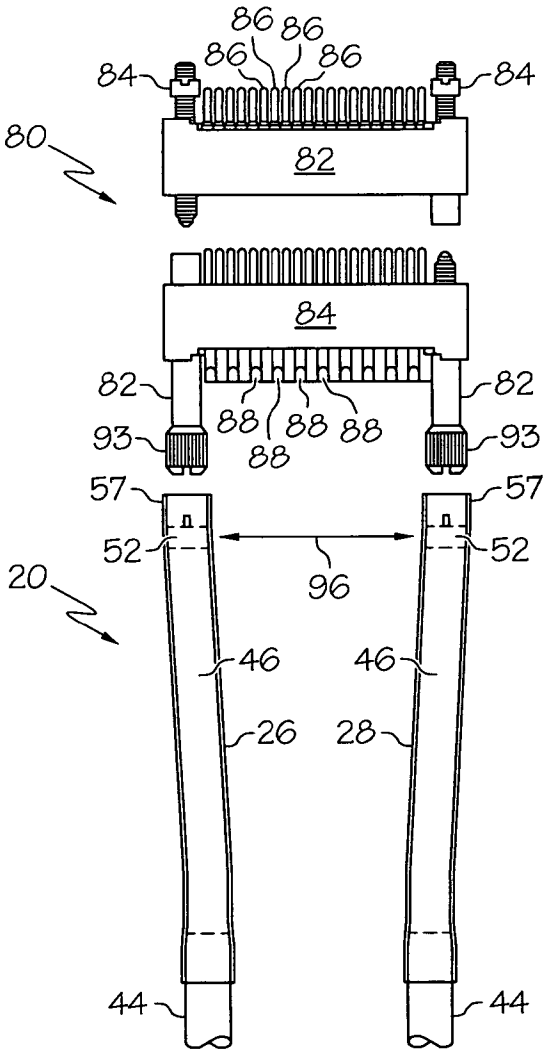
FIG. 7 is an exploded side view of the distal end portion of the dual screwdriver shown in FIG. 1 illustrating one manner in which the exemplary dual screwdriver may interface with the twenty-pin connector assembly shown in FIG. 6.
Figure 6:
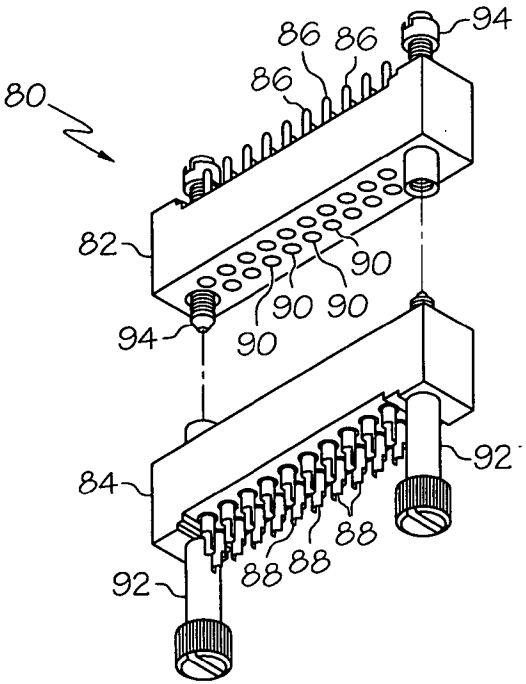
FIG. 6 (PRIOR ART)
FIG. 6 is an exploded isometric view of an exemplary twenty-pin connector assembly including first and second jackscrew guideposts each having slotted head.

FIG. 6 is an exploded isometric view of a second exemplary high density connector assembly 80, and FIG. 7 is an exploded side view of connector assembly 80 illustrating one manner in which assembly 80 may be engaged by the distal portion of dual screwdriver 20. In many respects, connector assembly 80 is similar to connector assembly 60 described above in conjunction with FIGS. 4 and 5. For example, connector assembly 80 includes a female receptacle 82 and a male plug 84, which carry a first array of contacts 86 and a second array of contacts 88, respectively. First and second jacksets are mounted to connector assembly 80 on opposing sides of contacts 86 and 88. As was the case previously, each jackset includes a jackscrew guidepost 92, which is rotatably disposed through plug 84, and a jackscrew 94, which is rotatably disposed through receptacle 82. When connector assembly 80 is properly connected, jackscrew guideposts 92 threadably engage jackscrews 94 to secure receptacle 62 to plug 84, and receptacle 82 matingly engages plug 84 such that contacts 86 extend into apertures 90 provided in the inner face of plug 84 and electrically contact contacts 88.

In contrast to jackscrew guideposts 72 (FIGS. 4 and 5), which each included a head having a hexagonal socket therein, jackscrew guideposts 92 each include a knurled head 93 having a slotted depression therein of a predetermined size. In addition, receptacle 82 and plug 84 each carry twenty contacts. Due to this higher contact count, the lateral spacing between jackscrew guideposts 92 is greater than the lateral spacing between jackscrew guideposts 72 (FIGS. 4 and 5); e.g., as an example, the lateral spacing between jackscrew guideposts 92 may be approximately 1.150 inch. Despite these structural differences, dual screwdriver 20 may still be utilized to connect or disconnect connector assembly 80 in the following manner. First, to accommodate slotted head jackscrew guideposts 92, a technician may exchange each hexagonal bit 50 with an appropriately-sized flat head bit 52 (also shown in FIG. 3). Second, as indicated in FIG. 7 by doubled-headed arrow 96, the technician may bend manually-bendable shafts 26 and 28 to increase the lateral spacing between bits 52 and thereby accommodate the increased lateral spacing between guideposts 92. Next, the technician positions dual screwdriver 20 such that each flat head bit 52 engages slotted depression provided in the knurled head 93 of its corresponding jackscrew guideposts 92. As noted above, an annular shroud 57 provided around each flat head bit 52 circumferentially engages an outer surface of the knurled head 93 of its corresponding jackscrew guidepost 92 to help maintain engagement between bits 52 and guideposts 92. Finally, the technician rotates user input 24 to drive the simultaneous rotation of manually-bendable shafts 26 and 28, and therefore the simultaneous rotation of jackscrew guideposts 72, to connect or disconnect connector assembly 80 as desired.

There has thus been provided an exemplary embodiment of a dual screwdriver suitable for connecting and disconnecting high density electrical connector assemblies of various types and sizes. Specifically, in the above-described exemplary embodiment, the dual screwdriver included first and second manually-bendable shafts configured to be bent by a technician to accommodate the lateral spacing between the jackscrew guideposts of different connector assemblies. Also, in the above-described exemplary embodiment, the dual screwdriver permitted different bit types and sizes to be interchanged to accommodate different jackscrew guidepost head types, including guideposts having a slotted depression in their terminal ends but lacking knurled heads (in this case, the dual may include an annular shroud that circumferentially engage an outer sleeve of the jackscrew guidepost proximate the slotted depression). Advantageously, the dual screwdriver rotates two jackscrew guideposts simultaneously, in the same rotational direction, and at the same rotational rate to prevent the over-rotation of a single jackscrew guidepost and thereby decrease the likelihood of damaging a connector assembly contact.

While at least one exemplary embodiment has been presented in the foregoing Detailed Description, it should be appreciated that a vast number of variations exist. It should also be appreciated that the exemplary embodiment or exemplary embodiments are only examples, and are not intended to limit the scope, applicability, or configuration of the invention in any way. Rather, the foregoing Detailed Description will provide those skilled in the art with a convenient road map for implementing an exemplary embodiment of the invention. It being understood that various changes may be made in the function and arrangement of elements described in an exemplary embodiment without departing from the scope of the invention as set-forth in the appended Claims.

What is claimed is:

1. A dual screwdriver for connecting and disconnecting a connector assembly having first and second jackscrew guideposts, the dual screwdriver comprising:

a housing;

a user input rotatably coupled to the housing;

first and second manually-bendable shafts each having: (i) a proximal end portion rotatably coupled to the housing, and (ii) a distal end portion;

first and second adapters mounted within the distal end portions of the first and second manually-bendable shafts, respectively;

first and second bits matingly received by the first and second adapters, respectively, and configured to matingly engage the first and second jackscrew guideposts, the first and second manually bendable-shafts configured to be bent by a technician to adjust the lateral spacing between the first and second bits and thereby accommodate the lateral spacing between the first and second jackscrew guideposts; and a gear train disposed in the housing and mechanically coupling the user input to the first and second manually-bendable shafts such that the rotation of the user input drives the rotation of the first and second manually-bendable shafts and, therefore, the rotation to the first and second jackscrew guideposts when matingly engaged by first and second bits;

wherein the first and second manually-bendable shafts each comprise polymeric tubing, wherein the first and second adapters are inserted into and fully recessed within the open distal ends of the polymeric tubing of the first and second manually-bendable shafts, respectively, and wherein the first and second adapters each have a depression therein for matingly receiving the first and second bits, respectively.

2. A dual screwdriver according to claim 1 wherein the gear train comprises:

first and second driven gears; and a drive gear mechanically coupled to the first and second driven gears, the drive gear fixedly coupled to the user input and configured to rotate along therewith.

3. A dual screwdriver according to claim 2 wherein the first manually-bendable shaft further comprises:

a base post fixedly coupled between the first driven gear and the proximal end of the polymeric tubing of the first manually-bendable shaft.

4. A dual screwdriver according to claim 3 wherein the base post extends through a wall of the housing.

5. A dual screwdriver for connecting and disconnecting a connector assembly having first and second jackscrew guideposts, the dual screwdriver comprising:

a housing;

a gear train disposed in the housing, the gear train comprising:

first and second driven gears; and a drive gear disposed between and engaging the first and second driven gears;

a rotatable handle fixedly coupled to the drive gear;

a first manually-bendable shaft, comprising:

a first base post fixedly coupled to the first driven gear; and a first polymeric tubing having distal end portion and a proximal end portion into which the first base post extends; and a second manually-bendable shaft, comprising:

a second base post fixedly coupled to the second driven gear; and a second polymeric tubing having distal end portion and a proximal end portion into which to the second base post extends; and first and second adapters inserted into and fully recessed within the distal end portion of the first and second polymeric tubing, respectively, such that the first and second polymeric tubing extends distally beyond the first and second adapters to form annular shrouds around the first and second adapters;

first and second bits matingly received by the first and second adapters, respectively, and configured to matingly engage the first and second jackscrew guideposts;

wherein the manually-bendable shafts are configured to rotate in the same rotational direction and at the same rotational rate when the rotatable handle is manually rotated.

6. A dual screwdriver according to claim 5 wherein the first and second elongated flexible bodies are configured to be manually bent to adjust the lateral spacing of the first and flexible bits to the lateral spacing of the first and second jackscrew guideposts.

* * * * *